United States Patent [19]

Bilbrey et al.

[11] 4,204,513

[45] May 27, 1980

[54] HYDRAULIC SAFETY MECHANISM

[75] Inventors: Robert A. Bilbrey, Orinda; William O. Munroe, Rodeo; David G. Powell, Monrovia, all of Calif.

[73] Assignee: California Controls Company, Berkeley, Calif.

[21] Appl. No.: 960,953

[22] Filed: Nov. 15, 1978

[51] Int. Cl.[2] ..... F02B 77/00

[52] U.S. Cl. ..... 123/198 DB; 123/142; 123/41.15; 60/403; 60/431

[58] Field of Search ..... 123/198 DB, 142, 140 PG, 123/41.15; 91/42, 44, 419; 60/403, 431

[56] References Cited

U.S. PATENT DOCUMENTS

| | | | |
|---|---|---|---|
| 2,551,429 | 5/1951 | Eppens | 91/419 |
| 2,851,056 | 9/1958 | MacGlashan | 137/464 |
| 2,854,964 | 10/1958 | Wagner | 123/198 |
| 2,960,082 | 11/1960 | Smith | 123/179 |
| 3,056,393 | 10/1962 | Friddell | 123/41.15 |
| 3,153,403 | 10/1964 | Dobbs | 123/41.15 |
| 3,159,036 | 12/1964 | Miller et al. | 73/509 |
| 3,246,641 | 4/1966 | Goehring | 123/198 |
| 3,492,983 | 2/1970 | Vipperman | 123/198 |
| 3,533,391 | 10/1970 | Lockmuller | 123/198 |
| 3,603,205 | 9/1971 | Shearer | 91/45 |
| 3,603,306 | 9/1971 | Bonin | 128/145 A |
| 3,626,920 | 12/1971 | Maher | 123/198 DB |
| 3,777,729 | 12/1973 | Cote | 123/140 FG |
| 3,848,629 | 11/1974 | Young | 137/459 |
| 3,853,037 | 12/1974 | Denzler et al. | 91/440 |
| 3,853,110 | 12/1974 | van der Merwe | 123/198 DB |
| 3,973,550 | 8/1976 | Sparks et al. | 123/198 DB |
| 4,020,818 | 5/1977 | Lesnick et al. | 123/198 DB |
| 4,067,348 | 1/1978 | Davis | 137/87 |

*Primary Examiner*—Edgar W. Geoghegan
*Attorney, Agent, or Firm*—Fitch, Even & Tabin

[57] ABSTRACT

Three embodiments of a hydraulic safety mechanism are adapted to adjust the speed setting for an engine upon a reduction of pressure in a chamber, due for example, to loss of lubricating pressure, overspeeding of the engine or overheating, for example. In each embodiment, a speed control element for the engine is maintained in a normal operating position by a piston and cylinder combination which hydraulically blocks the chamber from the fluid drain in a normal operating position, the piston responding to reduced pressure in the chamber by communicating the chamber with the drain the piston thereby being hydraulically unlatched and permitting the speed control element to be repositioned to a reduced speed setting. A restrictive orifice, preferably of variable size and self-cleaning construction, regulates communication between the hydraulic circuit and the chamber. In another embodiment the safety mechanism includes a solenoid and accumulator chamber to adapt it for remote operation.

32 Claims, 10 Drawing Figures

FIGURE 8.
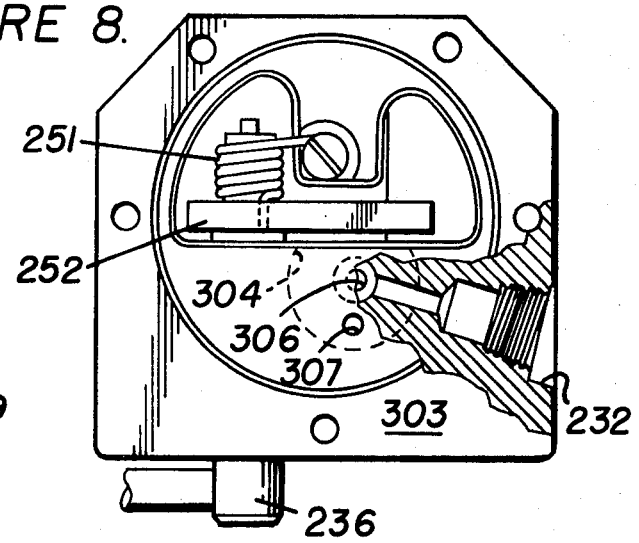
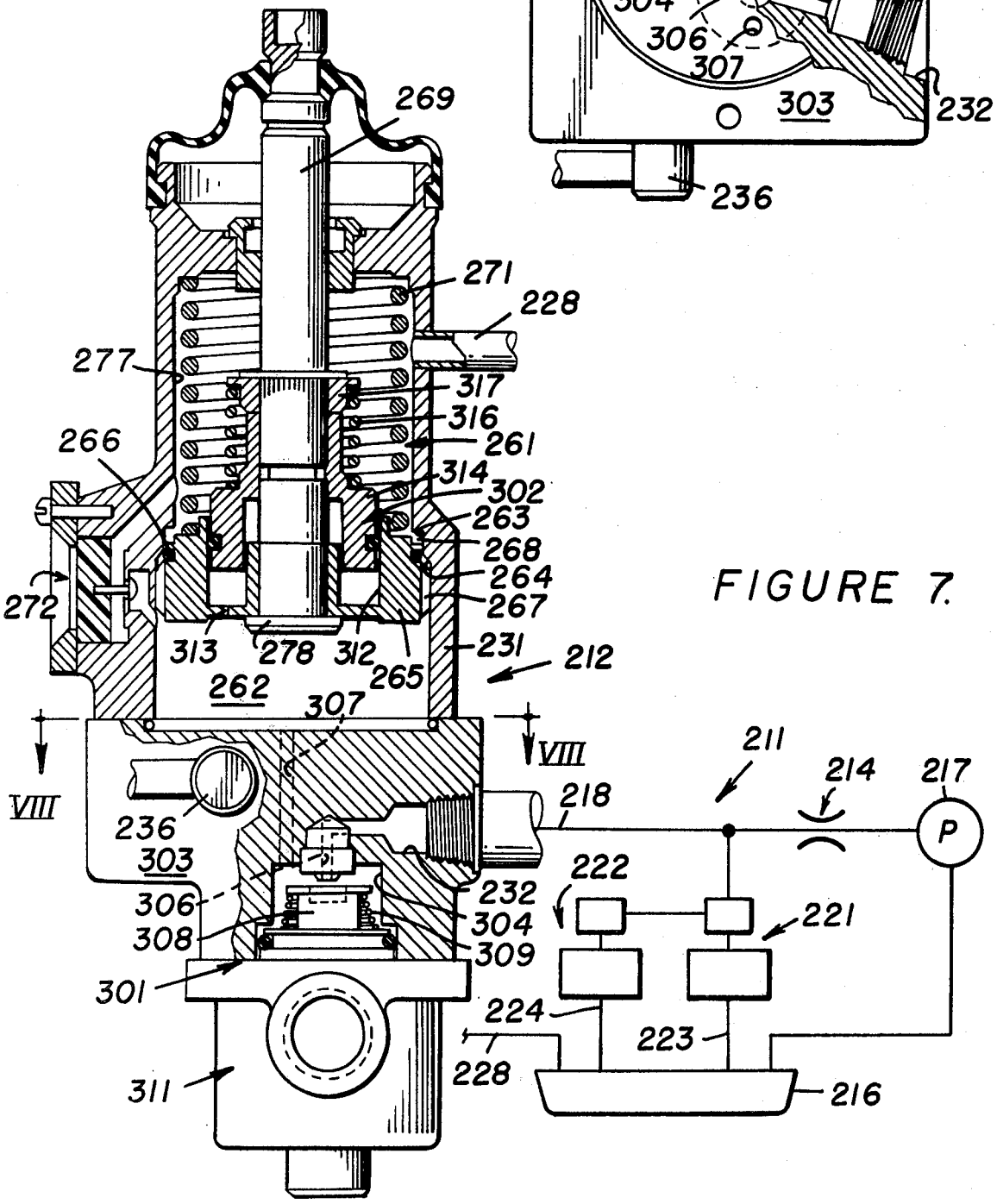
FIGURE 7.

HYDRAULIC SAFETY MECHANISM

The present invention relates to a hydraulic safety mechanism for use in connection with a system capable of developing hydraulic pressure during normal operation, the safety mechanism repositioning a control element of the system in response to a decrease of hydraulic pressure. The invention preferably relates to a hydraulic safety mechanism employed in connection with engines, more particularly with diesel engines, wherein operating speed of the engine is decreased or stopped in response to a malfunction causing a decrease of hydraulic pressure.

The hydraulic safety mechanism of the present invention is described below with particular reference to a shut-down system for use with an engine. Shut-down devices of this type are of particular importance in connection with engines employed in stationary applications such as emergency power generating sets including an engine operating either manually or remotely to power a generator for producing electrical power. In such an application, the engine may be required to operate over extended periods of time. Accordingly, in the event of a malfunction such as failure of lubricating pressure for the engine, excessive temperature or overspeeding of the engine, it is particularly important to immediately reduce the operating speed of the engine or to even shut down the engine entirely before excessive damage is caused. However, it will also be apparent that the hydraulic safety mechanism of the present invention may also be employed in a variety of other applications wherein hydraulic pressure may be produced to indicate a normal operating condition.

In the prior art, it has been common practice to employ mechanically latched safety devices which are triggered or released in response to a malfunction of the type described above. Upon becoming released or unlatched, the device repositions a control element such as a throttle or fuel rack in the fuel system of a diesel engine. The control element may of course be adjusted either to entirely shut down operation of the engine or system or to merely reduce operating speed to a safe level. In any event, it has been found that mechanical devices are subject to substantial forces produced for example by spring-loading of the mechanism resulting in substantial friction and wear upon various portions of the mechanical latch. Such mechanical devices may also be particularly subject to shock-loading and other undesirable operating characteristics. For example, excessive vibration or frictional wear may cause premature release of the mechanical latch which would reduce the operating speed of the engine or system even though the system experiences no abnormal operating condition.

In addition, where hydraulic pressure in a portion of an engine or system is sensed to detect normal operation, it has been known to use a restrictive orifice for communicating fluid under pressure with various sensing means. However, a number of problems have arisen in connection with the use of such orifices. Initially, the orifice may be employed so that a safety mechanism is responsive for example both to hydraulic pressure in the system as well as to additional sensors which are arranged downstream of the orifice.

A number of design parameters must be considered in connection with the size and location of the orifice. For example, a large orifice is undesirable for operation of sensors downstream from the orifice. In such an event, the sensor may vent fluid pressure from the circuit downstream of the orifice. However, a relatively large orifice allows additional fluid under pressure to be passed through the orifice from the system. Accordingly, response of a safety mechanism to a separately sensed condition such as engine overspeed, overheating or the like would be relatively impaired by use of a large orifice.

On the other hand, in many applications, hydraulic fluid used within the safety control circuit is provided for example by a lubricating portion of the engine or system. In order to detect decreases in lubricating oil pressure, a larger orifice is desirable in order to permit backflow of the fluid from the safety mechanism when there is a failure of lubricating pressure. In addition, during start-up conditions, especially when a high viscosity oil is being employed at low temperatures, a small orifice may require an excessive period in which to pressurize the safety circuit through the orifice. During that time, the safety circuit does not provide its normal function and is incapable of shutting down the engine or system in the event of an abnormal operating condition. Finally, the use of a small orifice is also undesirable because of the tendency for dirt or foreign material to collect therein and interfere with the proper passage of hydraulic fluid under pressure.

Accordingly, there has been found to remain a need for a hydraulic safety mechanism employable with engines or systems of the type described above which are of relatively simple and reliable design while providing accurate sensing of abnormal operating conditions and at the same time assuring continued operation of the engine or system in the absence of such abnormal conditions.

SUMMARY OF THE INVENTION

It is therefore an object of the invention to provide a hydraulic safety mechanism capable of overcoming one or more problems of the type referred to above.

It is a particular object of the invention to provide an improved safety latch mechanism for use with a system capable of generating hydraulic pressure under normal operating conditions, the safety mechanism including means for hydraulically latching a control element of the system in a normal operating position, a reduction of hydraulic pressure releasing the hydraulic latch and permitting the control element to be repositioned in order to protect the system against damage. A hydraulic latch or detent of this type avoids many problems associated with mechanical latching devices as described above. In addition, such a hydraulic latch permits rapid dumping of hydraulic pressure in order to achieve snap-acting release of the control element which is desirable in many applications.

It is also an object of the invention to provide a safety control circuit for use with a system of the type referred to above including variable orifice means for communicating hydraulic pressure from the system into the safety circuit, the variable orifice preferably being adapted to provide a relatively large passage during start-up conditions and a relatively small passage after normal operating conditions have been achieved.

It is yet another object of the invention to provide a variable orifice of the type referred to immediately above in combination with a check valve for permitting communication from the safety circuit to the hydraulic circuit of the system. After the system has achieved normal operating conditions and the small orifice communicates the hydraulic system with the safety circuit, the check valve permits very rapid response of the safety mechanism to failure of hydraulic pressure.

Yet another object of the invention is to provide self-cleaning means assuring that the orifice remains open, the self-cleaning means preferably functioning in response to adjustment of the orifice means to achieve a different effective orifice size.

The variable orifice, check valve and/or the self-cleaning function of the variable orifice may be employed in various combinations with each other and with the hydraulic latch mechanism described initially above. However, the invention does not contemplate a necessary combination of these components. For example, the hydraulic latch mechanism may be employed with or without the variable orifice as will be made more apparent by one of the embodiments described below. Similarly, the variable orifice, either with or without the one-way check valve and self-cleaning means, may also be employed according to the invention with or without the specific hydraulic latch safety mechanism referred to above and described in the following specification.

Additional objects and advantages of the invention are made apparent in the following description having reference to the accompanying drawings.

BRIEF DESCRIPTION OF THE DRAWINGS

FIG. 7 is also a longitudinally sectioned view of yet another embodiment of a hydraulic safety actuator including solenoid and accumulator means adapting it for self-cocking, remote operation.

FIG. 8 is a view, with parts in section, taken along section line VIII—VIII of FIG. 7.

DESCRIPTION OF THE PREFERRED EMBODIMENTS

Figure 1:
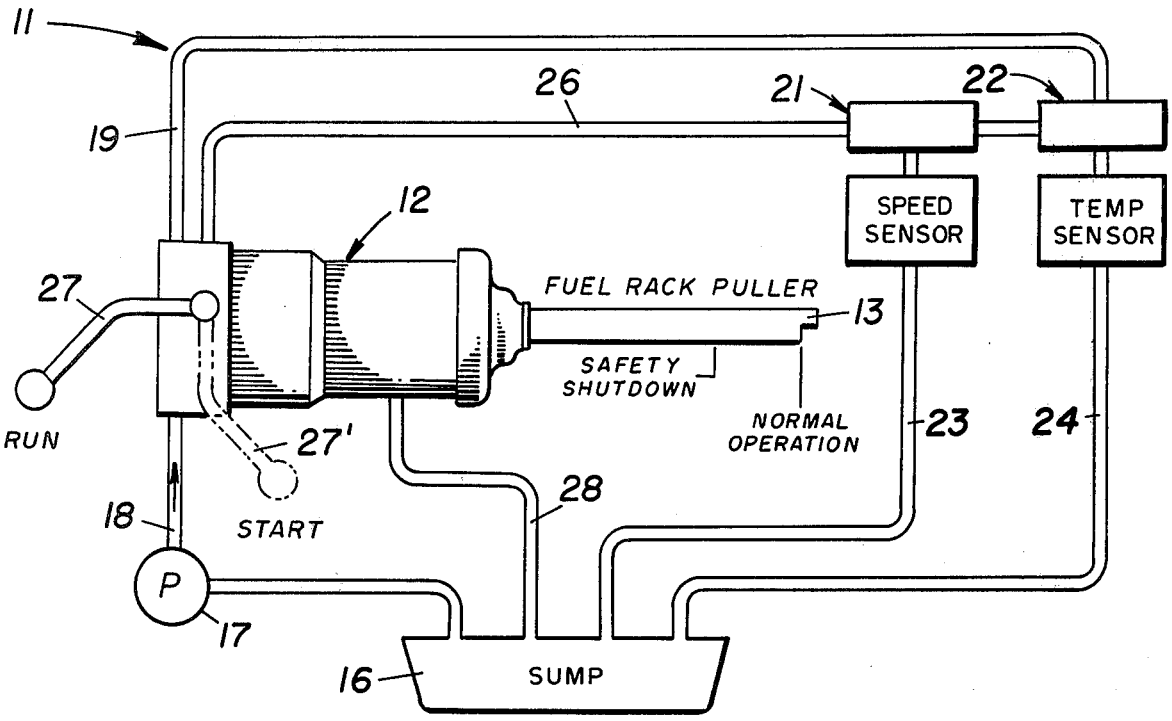
FIG. 1 is a schematic representation of a hydraulic safety circuit according to the present invention associated with components of a system embodying portions of a diesel engine.
Figure 2:
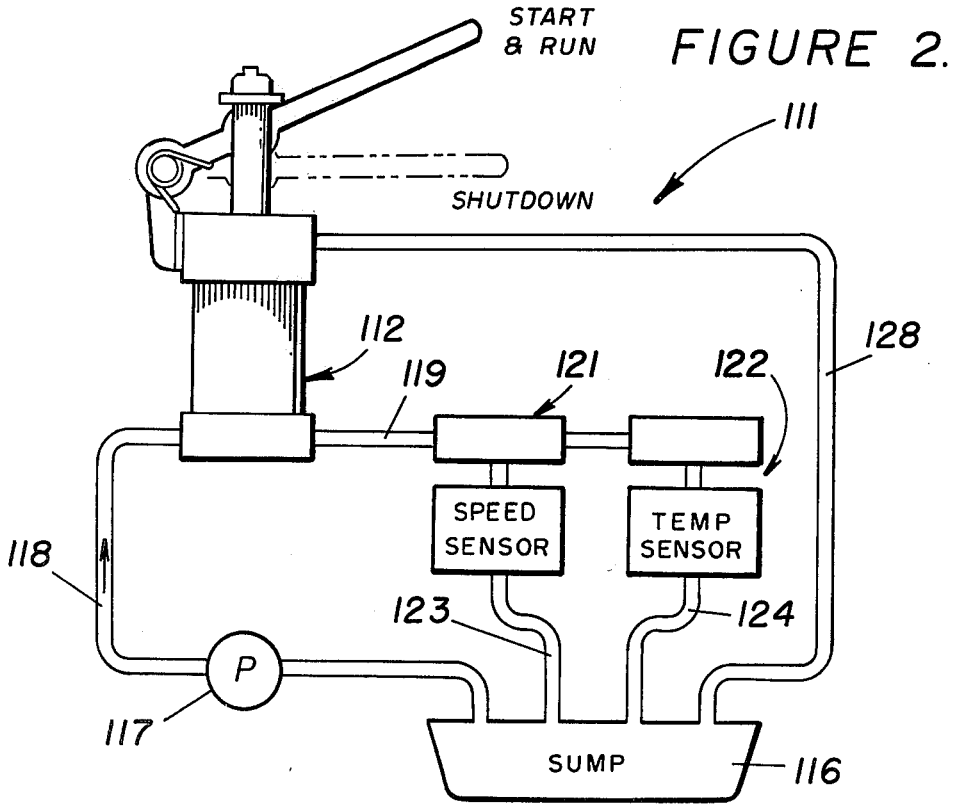
FIG. 2 is a similar schematic representation as in FIG. 1 while illustrating a different embodiment thereof.

The present invention is directed toward a hydraulic safety mechanism and associated components employed within a hydraulic circuit of the type illustrated in FIGS. 1 and 2 at 11 and 111 respectively. A hydraulic safety mechanism of the type contemplated by the present invention is indicated at 12 in the hydraulic safety circuit 11 of FIG. 1 while a second embodiment of a hydraulic safety mechanism according to the present invention is indicated at 112 in FIG. 2. Each of the hydraulic safety mechanisms 12 and 112 includes hydraulic latch or detent means for establishing a safe operating position for a control element with which the safety circuit 11 or 111 is associated. In FIG. 1, the control element is indicated at 13 as a fuel rack puller within the engine fuel control system for a diesel engine or the like (not otherwise shown). For purposes of the present invention, it is sufficient to understand that the fuel rack may be adjusted to a normal operating position establishing a predetermined operating speed for the engine. Such an arrangement is common particularly in stationary diesel applications such as emergency power generating sets and the like.

In the event of an engine malfunction, it is desirable to shut down the engine or at least to reduce its operating speed to a safe level in order to prevent further damage. As will be made apparent from the following description, the hydraulic safety mechanism of the present invention is particularly adapted to insure that it will remain functional even after long periods of operation and that it will rapidly actuate or reposition the control element 13. To adapt the hydraulic safety mechanism for accomplishing these functions, it is preferably employed in association with a variable orifice means for communicating hydraulic fluid under pressure from the circuit 11 or 111 to the safety mechanism. A variable orifice mechanism including self-cleaning means is generally indicated at 14 in each of FIGS. 3, 4 and 5A–C.

Figure 6:
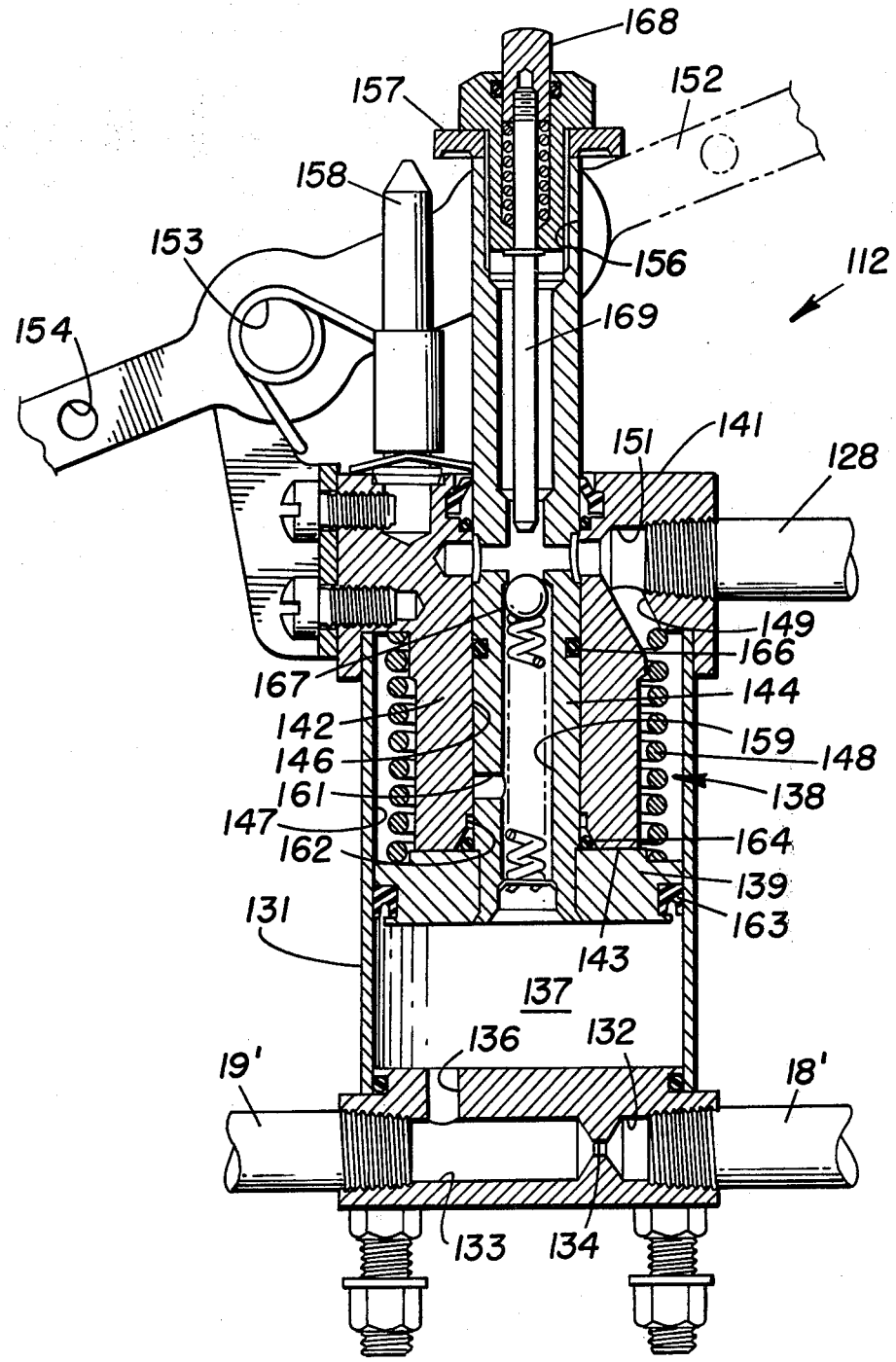
FIG. 6 is a longitudinally sectioned view of an alternate embodiment of a hydraulic safety actuator of FIGS. 3 and 4, the hydraulic safety actuator of FIG. 6 being particularly adapted for use in a safety circuit of the type illustrated in FIG. 2.

The alternate embodiment 112 of the hydraulic safety mechanism is best seen in FIG. 6. The hydraulic safety mechanism 112, in common with the mechanism 12 of FIGS. 3 and 4, includes hydraulic latching means serving to maintain the position of the control element 13 during normal operation and to reposition it in the event of a malfunction. However, the hydraulic safety mechanism 112 does not include variable orifice means and its manner of hydraulic communication with the safety circuit 111 of FIG. 1A is somewhat different from that for the hydraulic safety mechanism 12 in FIG. 1, particularly as to features of internal construction described in greater detail below.

It is further contemplated that such a hydraulic safety circuit and hydraulic safety mechanism may be employed in remote applications where it is not possible or feasible to manually accomplish start-up or resetting of the hydraulic safety mechanism. Accordingly, still another embodiment of the hydraulic safety mechanism is illustrated at 212 in FIGS. 7 and 8. The hydraulic safety mechanism 212 is generally similar to the hydraulic safety mechanism 112 of FIGS. 3 and 4 except that it includes solenoid means and an accumulator assembly to adapt it for remote, self-cocking operation.

The various hydraulic safety mechanism and associated components as well as the hydraulic safety circuits of FIGS. 1 and 2 are described in greater detail below. However, it is again noted that although these components are preferably described as portions of a hydraulic safety circuit for a diesel engine, they may also be employed with other systems including means for developing hydraulic pressure under normal operating conditions while being susceptible to regulation by a control element such as the fuel rack 13 in FIG. 1.

Referring now to FIG. 1, the safety circuit 11 is associated with selected components of a diesel engine or the like including the fuel rack 13, a hydraulic sump 16 and a source of hydraulic pressure or pump 17 suitable for developing hydraulic pressure. Preferably, the pump 17 is employed for developing lubricating pressure within the diesel engine. Fluid under pressure from the pump 17 is communicated through a conduit 18 to the safety device 12 and then to another conduit 19. The purpose of this arrangement is to direct fluid from the pump 17 through the variable orifice as will be described in detail below with reference to FIGS. 3 and 4. The conduit 19 is in communication with one or more sensors, such as the engine speed sensor assembly 21 and temperature sensor assembly 22. The sensor assemblies are each in communication with the sump by respective conduits 23 and 24. In addition, a return conduit 26 communicates the sensors with another inlet port of the safety device 12. The sensors 21 and 22 are adapted to vent the conduit 19 into the sump 16 upon sensing an abnormal operating condition of the system or diesel engine. Otherwise, hydraulic fluid under pressure in the conduit 19 is redirected to the hydraulic device 12 through the conduit 26.

As will also be described in greater detail below with reference to FIGS. 3 and 4, the hydraulic device 12 includes a cocking lever 27 illustrated in solid lines in a normal run position and also illustrated in phantom at 27' in a start position. In operation, during start-up of a diesel engine, the lever 27 is shifted to the start position in order to place the fuel rack 13 in a normal operating condition.

After the diesel engine is in operation and hydraulic fluid pressure is developed in the conduit 18 by the pump 17, a hydraulic latch assembly, described below with reference to FIG. 3, maintains the fuel rack 13 in its normal position. The cocking lever 27 is then shifted to its run position so that the position of the fuel rack 13 is controlled only by the hydraulic latch or detent assembly of the device 12. The hydraulic latch or detent assembly functions in response to fluid pressure from the conduit 18. Accordingly, upon failure of the pump 17 to develop sufficient lubricating pressure, reduced pressure is immediately communicated to the safety device 12 through the conduit 18. The hydraulic latching assembly responds to the reduced pressure by immediately releasing and permitting the fuel rack puller 13 to be shifted to a safety shut-down position. Similarly, if an abnormal operating condition is sensed by either of the sensor assemblies 21 or 22, fluid under pressure is vented from the safety device 12 through the conduit 19 and one of the vent conduits 23 or 24. Thereupon, the hydraulic latch similarly functions to shift the fuel rack puller to its safety shut-down position. Once the abnormal operating condition in the diesel engine or other system is corrected, start up may again be accomplished by shifting the lever 27 to its start position and repeating the start-up operation described above. Operation of the hydraulic latch serves to immediately vent fluid under pressure from the device 12 back to the sump through another conduit 28 in order to permit snap-action return of the fuel rack 13 to its safety shut-down position.

The safety circuit 111 of FIG. 2 functions in essentially the same manner described above for the safety circuit 11 of FIG. 1. However, the hydraulic safety device 112 of FIG. 2 does not include a variable orifice as will be more apparent from the following detailed description having reference to FIGS. 6 and 7. Accordingly, the sensor assemblies 121 and 122 are in communication with the safety device 112 only by means of the single conduit 119.

In operation, the safety device 112 functions similarly as described above in response to fluid under pressure from the pump 117. It is similarly responsive to operation of either of the sensor assemblies upon development of an abnormal operating condition in the diesel engine or other operating system.

Internal details of construction for the hydraulic safety device 12 are described immediately below having combined reference to FIGS. 3 and 4 as well as FIG. 1. The safety device 12 includes a fabricated housing 31 forming inlet and outlet ports 32 and 33 in respective communication with the conduits 18 and 19. The return conduit 26 is in communication with the interior of the safety device 12 by means of an inlet port indicated at 34 in FIG. 4.

The variable orifice assembly 14 is disposed within the housing 31 to regulate fluid communication between the ports 32 and 33. The variable orifice assembly 14 (also see FIGS. 5A–C) includes a shaft 36 coupled with the cocking lever 27 (see FIG. 1) and arranged within a bore 37 which transverses the outlet port 33. O-rings 38 are disposed upon the shaft on opposite sides of the bore 33 to prevent fluid leakage within the housing.

Figure 4:
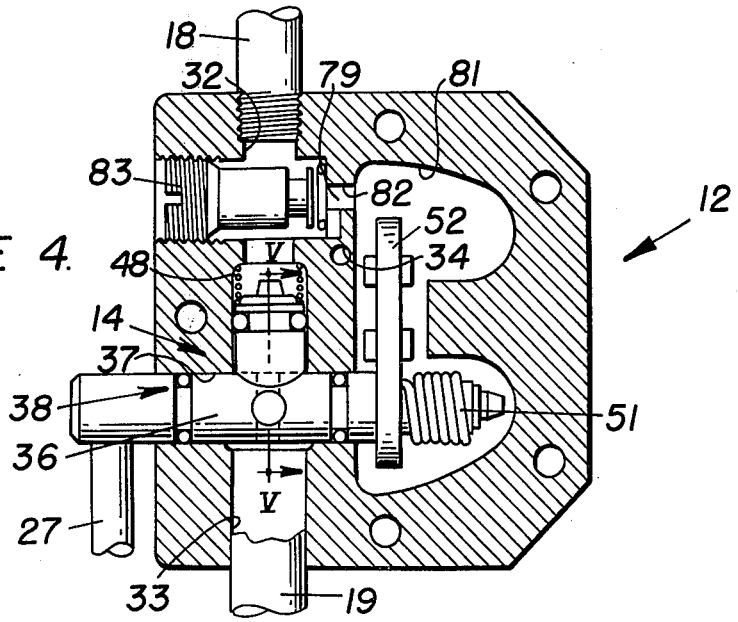
FIG. 4 is a view, with parts in section, taken through a lower portion of the hydraulic safety actuator as viewed in FIG. 3.
Figure 5C:
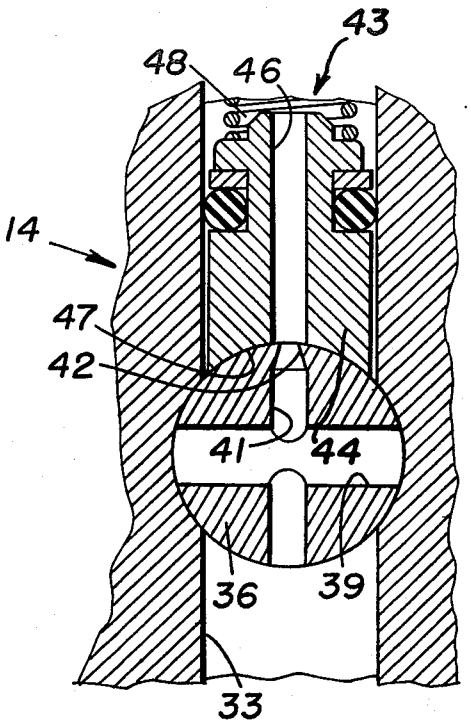
FIGS. 5A, 5B and 5C are each fragmentary representations taken along section line V—V in FIG. 4 to more clearly illustrate a variable orifice and associated self-cleaning means for use in combination with the hydraulic safety actuator of FIGS. 3 and 4, FIGS. 5A, 5B and 5C respectively illustrating those components in position for start-up, self-cleaning transition from start-up to run and running operation.
Figure 5B:
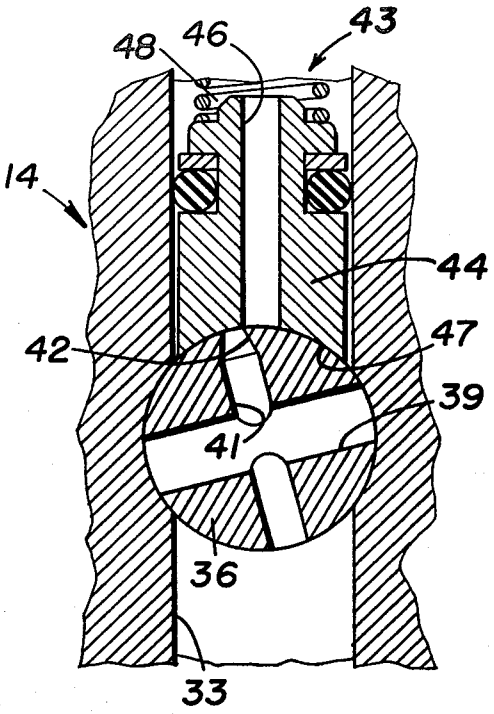
Figure 5A:
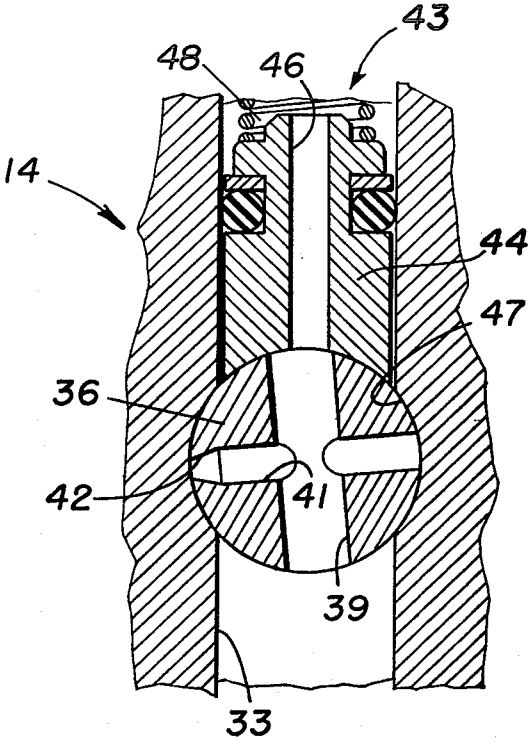

Referring momentarily to FIGS. 5A–C, the orifice shaft 36 is formed with cross-drilled passages 39 and 41, either of which may serve to communicate fluid between the ports 32 and 33 (also see FIG. 4) depending upon the position of the cocking lever 27. The angular relation of passages 39 and 41 is selected so that when the cocking lever is in the start position indicated at 27', the unrestricted passage 39 provides a relatively large orifice communicating the ports 32 and 33 (see FIG. 5A). This assures that fluid is rapidly introduced into the safely circuit (see FIG. 1) under cold start-up conditions. When the cocking lever is shifted to its run position indicated at 27, fluid communication between the ports 32 and 33 is established by the other passage 41 which includes a restrictive orifice (see FIG. 5C). Thus, under normal running conditions, the restrictive orifice 42 serves to improve response of the hydraulic device 12 in accordance with the preceding discussion.

A self-cleaning accessory assembly 43 includes a tubular element 44 having an axial passage 46 providing constant communication between the inlet port 32 and the orifice shaft 36. The passage 46 is also positioned so that it is in communication with the passage 39 when the cocking lever is in its start position 27' and in communication with the passage 41 when the cocking lever is in its run position 27. The element 44 also forms a cylindrical recess 47 at the end of the passage 46. The cylindrical recess 47 closely conforms to the cylindrical shape of the shaft 36. With the element 44 being urged toward the orifice shaft by means of a spring 48, the cylindrical recess 47 tends to remain in contiguous relation with the shaft 36.

Referring again to FIGS. 5A–C, it may be seen that the smallest or restrictive portion of the orifice 42 is formed upon the periphery of the orifice shaft 36. Thus, as the orifice shaft 36 is rotated from the start position illustrated in FIG. 5A toward the run position illustrated in FIG. 5C, any foreign material tending to clog the restrictive orifice 42 is removed by interaction with the cylindrical recess 47 which, in effect, provides a knife edge passing closely adjacent the orifice 42. A return spring 51 is also secured to the shaft 36 and tends to urge the shaft 36 and cocking lever toward the run position illustrated at 27 in FIG. 1. In addition, a cocking cam 52 is secured for rotation with the orifice shaft 36. The cocking cam 52 functions in combination with the hydraulic latch assembly described immediately below.

Figure 3:
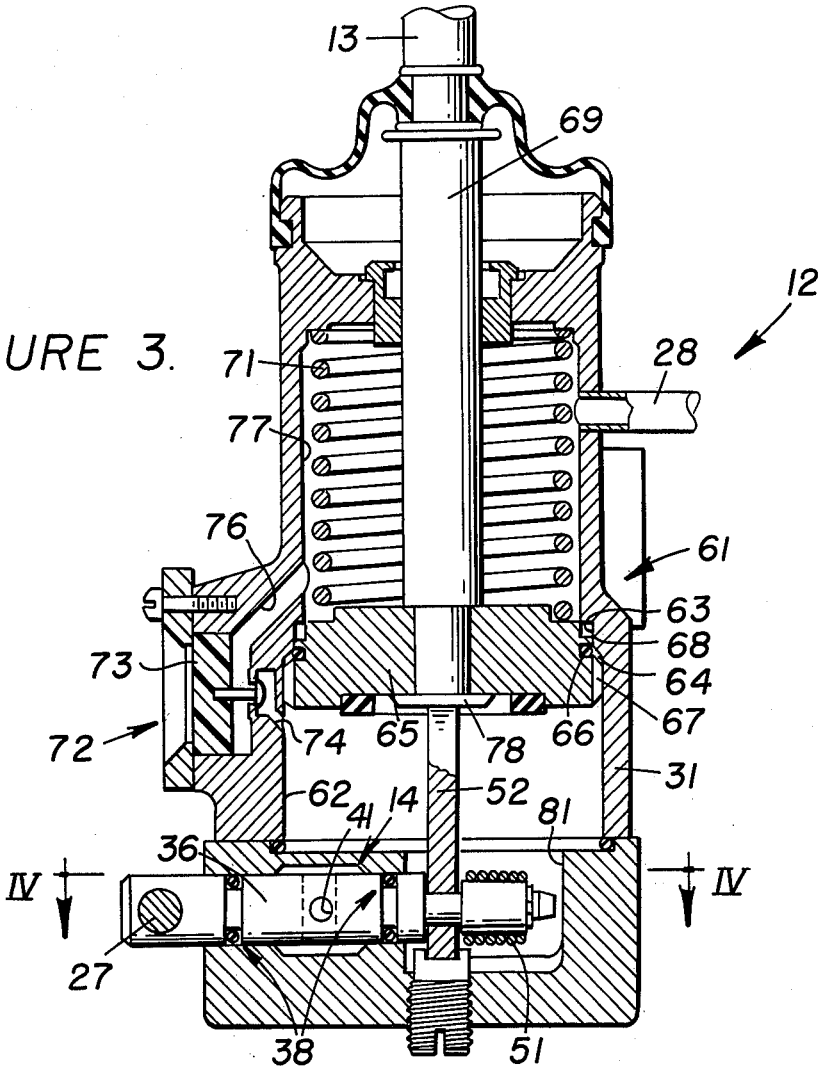
FIG. 3 is a longitudinal view, with parts in section, of a hydraulic safety actuator employed within the safety circuit of FIG. 1.

The hydraulic latch assembly of the device 12 is generally indicated at 61 in FIG. 3 and includes a cylindrical chamber or bore 62 formed by the housing 31 in communication with the additional inlet port 34 (see FIG. 4).

An upper portion 63 of the bore 62 is formed with a reduced diameter, the intersection between the stepped bores 62 and 63 forming a tapered seal surface 64. A piston 65 is disposed within the stepped bores and includes seal means such as the O-ring 66 arranged for sealing engagement with the surface 64. Guide fins 67 are circumferentially spaced about the piston 65 for engagement with the larger bore 62 while permitting free fluid communication with the seal surface 64. The piston 65 also includes a thin annular retaining ring 68 formed immediately above the O-ring 66 to maintain the O-ring in place and to facilitate rapid response of the hydraulic latch assembly.

The piston 65 is connected with the fuel rack 13 (see FIG. 1) by means of a shaft 68 which penetrates the end of the housing 31. A spring 71 is arranged about the shaft 69 and urges the piston 65 downwardly into the enlarged cylindrical bore 62.

A push-button shut-down assembly 72 is also provided to permit selective release of the hydraulic latch by an operator. For that reason, the assembly 72 includes a push-button valve assembly 73 which may be depressed in order to open a small passage 74, in communication with the cylindrical bore 62, into another passage 76 which is in communication with the spring chamber 77 formed above the piston 65. The spring chamber 77 is in turn in communication with the vent conduit 28 (see FIG. 1).

In operation, the cocking lever may be manually held in the position indicated at 27' during start-up. With the cocking lever in that position, the relatively large passage 39 provides communication between the ports 32 and 33 (see FIG. 5A) while the cocking cam 52 engages a friction pad 78 on the piston 65 and urges it upwardly into the position illustrated in FIG. 3 where the O-ring abuts the seal surface 64 and isolates the cylindrical chamber 62 from the spring chamber 77 and the drain passage 28. Operation of the pump 17 causes fluid pressure to be communicated through the conduits 18, 19 and 26 into the chamber 62 through the port 34. When the chamber 62 is filled and pressurized, the cocking lever may be allowed to return to its run position 27 with the piston 65 being held in the position illustrated in FIG. 3 by fluid pressure in the chamber 62. The spring 51 assures that the cocking lever is returned to the run position 27 when it is released by the operator.

With the piston 65 being in the position illustrated in FIG. 3, the fuel rack 13 (see FIG. 1) is maintained in its normal operating position. The piston 65 and fuel rack 13 are maintained in those positions by fluid pressure within the chamber 62. In the event that fluid pressure is reduced in the chamber 62, the piston 65 is shifted downwardly by the spring 71. Only a limited amount of downward movement of the piston 65 causes both the O-ring 66 and annular ring 68 to move below the seal surface 64 so that fluid from the bore 62 may pass freely into the spring chamber 77 and into the drain passage 28. This permits fluid to be rapidly exhausted from the bore 62 under force developed by the spring 77 so that the piston 65 is rapidly shifted downwardly by the spring 71 to accomplish snap-action movement of the fuel rack 13 into its safety shut-down position.

Pressure reduction in the bore 62 may be initiated by actuation of either of the sensor assemblies 21 or 22. In that event, the restrictive orifice 42 prevents the pump 17 from maintaining full pressurization within the chamber 62. On the other hand, pressure reduction in the chamber 62 may also be caused by failure of the pump 17. In that event, a one-way check valve 79 responds to a pressure drop in the conduit 18 and immediately places the chamber 62 in direct communication with the inlet conduit 18. For this reason, the one-way check valve 79 is in communication with the cylindrical chamber 62 by means of a recessed portion 81 also adapted to receive the cocking cam 52 when the cocking lever is in its run position 27 and a passage 82. The one-way check valve 79, which is adjustable by means of an external screw 83, provides improved response of the hydraulic latch assebly 61 to failure of the pump 17 to maintain adequate lubricating pressure.

Once the hydraulic latch assembly is released, it remains in that condition until the abnormality is corrected. Thereafter, start-up may be accomplished in the same manner described above.

Referring now to FIG. 6, the hydraulic safety mechanism 112 functions within the hydraulic safety circuit 111 of FIG. 2 in generally the same manner described above for the hydraulic safety mechanism 12 within the circuit 11 of FIG. 1. As was also noted above, the hydraulic safety mechanism 112 does not include a variable orifice. Accordingly, the safety circuit 111 of FIG. 2 does not include an additional inlet port corresponding to the port 34 of FIG. 1. Otherwise, the hydraulic safety mechanism 112 includes a hydraulic latch assembly functioning in generally the same manner as the hydraulic latch assembly 61 of FIG. 3. However, it is also to be noted that construction details for the hydraulic latch assembly of the mechanism 112 of FIG. 2 and FIG. 5 differ substantially from that described above with reference to FIGS. 3 and 4.

Referring now to FIG. 6, the hydraulic safety mechanism 112 includes a housing 131 forming inlet and outlet ports 132 and 133 which are in communication with each other by means of a fixed restrictive orifice 134. The outlet port 133 on the downstream side of the orifice 134 is also in communication with a cross-drilled passage 136.

The passage 136 is also in communication with a cylindrical chamber or bore 137 formed by the housing 131 as part of a hydraulic latch assembly 138. The hydraulic latch assembly 138 also includes an annular piston 139 reciprocably arranged for movement within the cylindrical bore 137. The housing 131 includes a fabricated portion 141 forming an annular member 142 extending downwardly into the cylindrical bore 137 and defining an annular stop surface 143 at its lower end for abutting engagement with the piston 139. A hollow rod 144 is secured in coaxial relation with the piston 139 and extends upwardly through an inner cylindrical bore 146 formed by the annular member 142.

The spring chamber 147 is formed between the outer diameter of the annular member 142 and the housing 131 and contains a return spring 148 interacting between the housing portion 141 and the piston 139. The spring chamber 147 is also in communication with the drain conduit 128 (see FIG. 2) by means of interconnecting passages 149 and 151 formed by the housing portion 141.

The hydraulic safety mechanism 112 of FIG. 6 is illustrated in a cocked or normal operating position corresponding to a normal operation condition for the hydraulic safety circuit 111 of FIG. 2. For example, with the safety circuit 111 being employed in conjunction with a diesel engine or the like, the position of the hydraulic safety mechanism 112 would correspond with a normal speed setting for the diesel engine.

Within the embodiment of FIG. 6, the rod 144 which is connected with the piston 139 is also connected with a pivoted cocking lever 152. The cocking lever 152 is pivoted at 153 and may be coupled with a control element such as the fuel rack 13, for example at 154. The lever 152 is formed with an opening 156 to receive the rod 144. The rod 144 in turn is formed with a flange 157 at its upper end for interaction with the lever 152.

A start-up latch 158 is resiliently secured to an upper portion of the housing 131 and may be positioned under the flange 157 to maintain the piston 139 in the raised position illustrated in FIG. 6 during start-up conditions as described below. It will be apparent from the following description that, when operating fluid pressure is developed within the chamber 137, the rod 144 and latch 157 are raised sufficiently to permit the start-up latch to return to the unlatched position illustrated in FIG. 6. This feature is important to assure that the latch 158 does not prevent downward movement of the piston 139 in response to pressure failure in the chamber 137.

The hollow rod 144 forms an axial passage 159 which is in communication with the inner bore 146 of the annular member 142 by means of a cross-drilled passage 161. With the piston 139 and rod 144 in the normal operating position as illustrated in FIG. 6, the cross-drilled passage 161 is slightly above an annular recess 162 formed at the bottom of the inside bore 146 of the annular extension 142.

Various O-ring type seals are provided to prevent undesirable leakage within the housing 131. The most important of these is an O-ring 163 disposed about the periphery of the piston 139 for sealing engagement with the housing 131 to prevent leakage between the cyindrical bore 127 and the spring chamber 147. Similarly, an O-ring 164 is disposed within the annular recess 162 to prevent undesirable leakage between the piston 139 and the lower stop surface 143 of the annular member 142 at least when those elements are in abutting engagement as illustrated in FIG. 6. Another O-ring 166 is arranged about the periphery of the rod 144 above the cross-drilled passage 161.

Fluid communication upwardly through the axial passage 159 of the rod 144 is controlled by a spring-loaded check valve 167. A push button 168 mounted atop the rod 144 is secured to a spring-loaded pin 169 penetrating downwardly through the rod 144 toward the check valve 167. As will be described in greater detail below, this assembly permits emergency shut-down of the diesel engine or other system controlled by the safety mechanism 112 by urging the check valve 167 downwardly in order to communicate the cylindrical chamber or bore 137 with the drain passage 128.

In operation, prior to start-up of the diesel engine or system with which the safety mechanism 112 is associated, the piston 139 is normally urged downwardly into the cylindrical bore 137 by the return spring 148. During start-up, the piston 139 and rod 144 are urged upwardly against the spring 148 by the cocking lever until sufficient pressure is developed within the chamber 137. The cocking lever may be held in the position illustrated in FIG. 6 to maintain the piston in the illustrated position until the chamber 137 is pressurized. Alternatively, the start-up latch 158 may be employed to hold the piston 139 and rod 144 in their raised positions against the spring 148. In that event, once operating pressure is developed within the chamber 137, the rod 144 is urged upwardly to permit the start-up latch 158 to disengage from the flange 157. Accordingly, the hydraulic latch assembly 138 would thereafter be responsive to a failure or reduction of hydraulic fluid pressure within the chamber 137.

Once operating hydraulic pressure is developed in the chamber 137 with the various components of the hydraulic safety mechanism in their illustrated positions, operation continues in uninterrupted fashion until a failure or reduction of pressure occurs in the chamber 137. Such pressure failure could of course occur because of pump failure or due to operation of one of the sensors 121 or 122 (see FIG. 2). In such an event, the piston 139 and rod 144 would be urged downwardly into the chamber 137 by the spring 148. Incremental movement of the piston 139 would form a passage between the piston and the lower surface 143 of the annular element 142. Similarly, downward movement of the rod 144 would place the cross-drilled passage 161 in communiction with the recess 162 and accordingly in communication with the spring chamber 147 and the drain conduit 128. As soon as the rod 144 is shifted downwardly sufficient to form such communication, rapid drainage of fluid from the chamber 137 is permitted, action of the spring 148 thereafter causing snap-action movement of the piston and rod 144 serving to interrupt operation of the associated system in the same manner described above with reference to FIGS. 1 and 3. Thereafter, the hydraulic safety mechanism 112 would remain in this shut-down condition until the reason for pressure failure were corrected, start-up thereafter being initiated in the same manner described above.

It will of course be apparent that shut-down could also be accomplished by manipulation of the push-button 168 which similarly serves to shift the check valve 167 and directly communicate the cylindrical chamber 137 through the axial passage 159 with the drain passage 128.

Yet another embodiment of the invention is illustrated in FIGS. 7 and 8. The embodiment of FIG. 7 includes a hydraulic safety circuit 211 with a hydraulic safety mechanism 212. Since many portions of both the hydraulic safety circuit 211 and hydraulic safety mechanism 212 correspond with components described above with reference to FIGS. 1 and 3, the following description of FIG. 7 is based on similar numerical labels preceded by the additional digit "2". In general, the hydraulic safety circuit 211 includes substantially the same components as the hydraulic safety circuit 11 of FIG. 1. However, the hydraulic safety circuit 211 includes only a single conduit 218 in fluid communication with the hydraulic safety mechanism 212, except for the return drain line 228.

Within the hydraulic safety mechanism 212, a hydraulic latch assembly 261 is substantially similar to that indicated at 61 in FIG. 2. A restrictive orifice 214 provided within the hydraulic safety circuit 211 serves a generally similar function as the variable orifice 14 of FIG. 1.

The embodiment of FIGS. 7 and 8 differs from that of FIG. 1 primarily in the addition of a solenoid operated valve 301 which regulates communication from the inlet conduit 218 into the chamber or bore 262 of the hydraulic latch assembly 261. In addition, an accumulator assembly 302 functions in combination with the hydraulic latch assembly 261 and the solenoid operated valve 301 in order to adapt the hydraulic safety mechanism 212 and the hydraulic safety circuit 211 for unattended operation as would be required for example in a remote location.

The solenoid operation valve assembly 301 is disposed within a lower portion 303 of the housing 231. The housing portion 303 defines an intermediate chamber 304 which is in communication with the inlet conduit 218 and passage 232 by means of a passage 306. The chamber 304 is also in communication with the cylindrical chamber or bore 262 by means of another passage 307 (also see FIG. 8). A solenoid controlled movable seal element 308 is disposed within the chamber 304 for regulation by both a spring means 309 and a solenoid 311. Under normal operating conditions, when the solenoid unit 311 is energized for example by a diesel engine associated with the hydraulic safety circuit 211, the seal element 308 is retracted into the position illustrated in FIG. 7 to permit free communication between the passages 306 and 307. However, in the absence of energizing power to the solenoid 311, the seal element 308 is urged upwardly by the spring means 309 to close the passage 306 and prevent fluid in the chamber 262 from communication with the inlet conduit 318. As will be described in greater detail below, this feature tends to maintain the hydraulic latch assembly 261 in a cocked condition when operation of a diesel engine or the like associated with the hydraulic safety circuit 211 is interrupted.

The accumulator assembly 302 assures that pressurization of the chamber 262 is maintained during such periods of interrupted operation. The accumulator assembly 302 includes an annular chamber 312 formed by the piston 265 in communication with the chamber 262 by means of a small orifice 313. The upper end of the annular chamber 312 is closed by an annular piston 314. A spring 316 is arranged for interaction between the annular piston 314 and a spring retainer 317 secured to the shaft 269.

In operation, the cocking cam 252 may be positioned by the shaft 236 to raise the piston 265 during initial start-up of the hydraulic safety circuit 211. During operation of a diesel engine or the like, with which the safety circuit 211 is associated, the solenoid unit 311 is also energized and retracts the seal element 308 to permit pressurization of the chamber 262 by hydraulic fluid from the inlet conduit 218.

With the hydraulic safety mechanism 212 in this condition, it is similarly responsive to failure of the pump 217 to supply adequate operating pressure to the inlet conduit 218 or to actuation of either of the sensor assemblies 221 and 222 to vent the inlet conduit 218 into communication with the sump 216. If any of these abnormal conditions arises, pressure in the chamber 262 is reduced similarly as described above, in connection with the embodiments of FIGS. 1 and 3, resulting in downward movement of the piston 265 (FIG. 7). Movement of the piston 265 of course vents the chamber 262 across the seal surface 264 and through the spring chamber 277 into the drain passage 228 to result in snap-action movement of the shaft 269. With the shaft 269 connected with a control element such as that indicated at 13 in FIG. 1, the hydraulic safety circuit 211 either terminates or reduces operating speed of the diesel engine or the like to a safe level.

The solenoid operated valve 301 and the accumulator assembly 302 maintain the hydraulic latch assembly 261 in a cocked condition when operation of the diesel engine is interrupted. When operation of the engine is terminated, the solenoid unit 311 is simultaneously de-energized and the spring 309 urges the seal element 308 upwardly to block communication between the passages 306 and 307. Fluid pressure within the cylindrical chamber 262 is then trapped and the piston 265 tends to remain in the position illustrated in FIG. 7 until the engine is again started up and fluid pressure delivered through the inlet conduit 218 by operation of the pump 217.

However, during such periods of interruption, it is necessary to provide makeup fluid to the chamber 262 in order to compensate for volume lost through leakage or cooling of fluid in the chamber 262. During operation of the hydraulic safety circuit 211, the fluid supplied to the chamber 262 is relatively hot. Over an extended period of interrupted operation, fluid in the chamber 262 tends to decrease resulting in lowered pressure within the chamber. Normally, such a pressure reduction might permit the piston 265 to move downwardly along with the seal ring 266 so that fluid from the chamber 262 could escape across the seal surface 264. Such a possibility is prevented by make-up fluid supplied from the accumulator chamber 312 through the restrictive orifice 313. The chamber 312 is, of course, pressurized along with the chamber 262. Thus, a minimum pressure level is assured within the chamber 262 by the accumulator assembly 302.

Additional variations are believed obvious within the three embodiments described above. For example, certain auxiliary components such as the variable orifice 14 of FIG. 1 could be employed with either the hydraulic safety circuit 111 of FIG. 2 or the safety circuit 211 of FIG. 7. Similarly, other components of the three embodiments could be interchanged while permitting operation of the hydraulic safety circuit and hydraulic safety mechanism in accordance with the present invention. Other changes and variations are of course possible within the scope of the present invention which is therefore defined only by the following appended claims.

What is claimed is:

1. A hydraulic safety mechanism for a system wherein a control element of the system is to be moved from a normal operating position in response to a decrease of pressure in a hydraulic portion of the system, comprising a housing forming a cylinder having one end in communication with the hydraulic portion of the system said housing also forming a fluid drain, a piston being reciprocably arranged in said cylinder and operatively connected with the control element of the system, said piston being movable between a first position adjacent said one end of the cylinder and a second position spaced apart therefrom, said piston and cylinder including means for hydraulically blocking said cylinder from said fluid drain when said piston is in its second position and for opening said cylinder into communication with said fluid drain as said piston is moved from its second position toward its first position, means resiliently urging said piston toward its first position, hydraulic pressure in said one end of said cylinder hydraulically latching said piston in its second position in order to maintain the control element of the system in its normal operating position, said piston being responsive to a decrease of pressure in the cylinder for communicating the cylinder with the drain in order to hydraulically unlatch the piston and allow it to rapidly move toward its first position whereupon the control element is shifted from its normal operating position.

2. The hydraulic safety mechanism of claim 1 further comprising sensor means for monitoring a selected operating condition of the system, said sensor means being coupled with vent means in communication with said cylinder and operable in response to an abnormal condition in the system to vent fluid pressure from said cylinder, said housing also forming a restrictive orifice for communicating the hydraulic portion of the system with said cylinder.

3. The hydraulic safety mechanism of claim 2 wherein said restrictive orifice includes means for reducing the effective size of said orifice after normal operating pressure is developed in the hydraulic portion of the system.

4. The hydraulic safety mechanism of claim 3 further comprising a one-way check valve for communicating hydraulic fluid pressure from said cylinder to the hydraulic portion of the system.

5. The hydraulic safety mechanism of claim 2 further comprising a one-way check valve for communicating hydraulic fluid pressure from said cylinder to the hydraulic portion of the system.

6. The hydraulic safety mechanism of claim 3 further comprising self-cleaning means for removing blockage from said variable orifice and functioning in response to said means for reducing the effective size of said orifice.

7. The hydraulic safety mechanism of claim 1 wherein said hydraulic blocking means comprises an annular seal means formed on said cylinder, said piston including annular seal means for engaging said annular seal means on the cylinder when the piston is in its second position.

8. The hydraulic safety mechanism of claim 7 wherein one of said annular seal means on said cylinder and said piston is a resilient seal member.

9. The hydraulic safety mechanism of claim 1 wherein said piston forms a passage for communicating said one end of said cylinder with said fluid drain and further comprising means arranged within said cylinder for abutting engagement with said piston to close said passage when said piston is in its second position.

10. The hydraulic safety mechanism of claim 9 further comprising manually operable means for communicating said one end of said cylinder with said fluid drain and selectively releasing said piston from its second position.

11. The hydraulic safety mechanism of claim 1 further comprising manually operable means for communicating said one end of said cylinder with said fluid drain in order to release said piston from its second position.

12. The hydraulic safety mechanism of claim 1 further comprising means for engaging said piston and maintaining it in its second position until operating pressure is developed in said one end of said cylinder.

13. The hydraulic safety mechanism of claim 1 wherein said system includes motor means and a pump driven by said motor means for developing hydraulic pressure in the hydraulic portion of the system, the hydraulic safety mechanism further comprising solenoid valve means operated by said motor means, said solenoid valve means communicating said one end of said cylinder with the hydraulic portion of the system when said motor means is operating and blocking said one end of said cylinder from the hydraulic portion of the system when operation of the motor means is interrupted.

14. The hydraulic safety mechanism of claim 13 further comprising accumulator means in restricted communication with said one end of said cylinder to provide make-up fluid for maintaining minimum pressurization in said one end of said cylinder and thereby preventing said piston from becoming inadvertently released from said second position.

15. The hydraulic safety mechanism of claim 13 wherein said motor means is a diesel engine.

16. A hydraulic safety mechanism for an engine including a speed control element having a normal operating position for establishing normal operating speed of the engine, the engine including a hydraulic circuit subject to normal pressurization during normal operation of the engine, comprising a housing forming a chamber, a cylinder being in respective communication with the chamber and a fluid drain, a piston being reciprocably disposed in said cylinder and coupled with the speed control element of the engine, said piston and cylinder including means for hydraulically blocking said cylinder from said fluid drain when said piston is retracted away from said chamber, said means formed by said piston and cylinder communicating said chamber with said fluid drain as said piston is moved toward said chamber from its retracted position, resilient means urging said piston toward said chamber, means communicating the hydraulic circuit with said chamber, and a sensor means for detecting an abnormal operating condition in the engine being operatively coupled with a vent arranged in communication with said chamber for relieving fluid pressure therefrom upon occurrence of an abnormal operating condition in the engine.

17. The safety mechanism of claim 16 further comprising means forming a restrictive orifice for communicating the hydraulic circuit with said chamber.

18. The safety mechanism of claim 17 further comprising a one-way check valve permitting fluid communication from said chamber to the hydraulic circuit.

19. The safety mechanism of claim 17 wherein said restrictive orifice includes means for reducing the effective size of said orifice after normal operating pressure is developed in the hydraulic circuit of the engine.

20. The safety mechanism of claim 19 further comprising self-cleaning means for removing blockage from said variable orifice and functioning in response to said means for reducing the effective size of said orifice.

21. The safety mechanism of claim 20 further comprising a one-way check valve for communicating hyraulic fluid pressure from said chamber to the hydraulic circuit of the engine.

22. The hydraulic safety mechanism of claim 16 wherein said hydraulic blocking means comprises an annular seal means formed on said cylinder, said piston including annular seal means for engaging said annular seal means on the cylinder when the piston is in its second position.

23. The hydraulic safety mechanism of claim 22 wherein one of said annular seal means on said cylinder and said piston is a resilient seal member.

24. The hydraulic safety mechanism of claim 16 wherein said piston forms a passage for communicating said chamber will said fluid drain and further comprising means arranged within said cylinder for abutting engagement with said piston to close said passage when said piston is in its second position.

25. The hydraulic safety mechanism of claim 24 further comprising manually operable means for communicating said chamber with said fluid drain and selectively releasing said piston from its second position.

26. The hydraulic safety mechanism of claim 16 further comprising manual means for communicating said chamber with said fluid drain in order to release said piston from its second position.

27. The hydraulic safety mechanism of claim 16 further comprising means for engaging said piston and maintaining it in its second position until operating pressure is developed in said chamber.

28. The hydraulic safety mechanism of claim 16 wherein said system includes motor means and a pump driven by said motor means for developing hydraulic pressure in the hydraulic portion of the system, the hydraulic safety mechanism further comprising solenoid valve means operable by said engine, said solenoid valve means communicating said chamber with the hydraulic portion of the system when the engine is operating and blocking said chamber from the hydraulic portion of the system when operation of the engine is interrupted.

29. The hydraulic safety mechanism of claim 28 further comprising accumulator means in restricted communication with said chamber to provide make-up fluid for maintaining minimum pressurization in said chamber and thereby preventing said piston from becoming inadvertently released from said second position.

30. A hydraulic safety mechanism for an engine having a speed control element for reducing operating speed of the engine in response to a decrease of pressure in a hydraulic portion of the engine, comprising a housing forming a chamber and containing hydraulic release means coupled with the speed control element and in communication with the chamber, said hydraulic release means being responsive to a decrease of pressure in the chamber for releasing the speed control element from its normal operating position, sensor means for monitoring a selected operating condition of the engine being coupled with vent means in communication with said chamber and operable in response to an abnormal condition in the system for venting fluid pressure from said chamber in order to cause release of said speed control element, said housing also forming a variable restrictive orifice for communicating the hydraulic circuit of the engine with said chamber, said restrictive orifice including means for reducing its effective size after normal operating pressure is developed in the hydraulic portion of the engine.

31. The hydraulic safety mechanism of claim 30 further comprising a one-way check valve for communicating hydraulic fluid pressure from said chamber to the hydraulic portion of the engine.

32. The hydraulic safety mechanism of claim 30 further comprising self-cleaning means for removing blockage from said restrictive orifice, said self-cleaning means functioning in response to said means for reducing the effective size of said orifice.

* * * * *